US008503909B2

(12) United States Patent
Yonemoto

(10) Patent No.: US 8,503,909 B2
(45) Date of Patent: Aug. 6, 2013

(54) IMAGE FORMING APPARATUS

(75) Inventor: Satoru Yonemoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 248 days.

(21) Appl. No.: 13/033,997

(22) Filed: Feb. 24, 2011

(65) Prior Publication Data

US 2011/0211862 A1 Sep. 1, 2011

(30) Foreign Application Priority Data

Feb. 26, 2010 (JP) ..... 2010-041941

(51) Int. Cl.
*G03G 15/08* (2006.01)

(52) U.S. Cl.
USPC ..... 399/121; 399/114; 399/116

(58) Field of Classification Search
USPC ..... 399/116, 119, 121
See application file for complete search history.

(56) References Cited

U.S. PATENT DOCUMENTS

| | | | | |
|---|---|---|---|---|
| 6,463,236 | B2 * | 10/2002 | Morikami et al. | 399/121 |
| 7,844,199 | B2 | 11/2010 | Suzuki et al. | |
| 2002/0098009 | A1 | 7/2002 | Nakamura et al. | |
| 2005/0074259 | A1 * | 4/2005 | Tachiki et al. | 399/121 |
| 2009/0123178 | A1 * | 5/2009 | Suzuki et al. | 399/121 |

FOREIGN PATENT DOCUMENTS

| | | |
|---|---|---|
| JP | 7-302007 | 11/1995 |
| JP | 2006-220993 | 8/2006 |
| JP | 2006-235347 | 9/2006 |
| JP | 2007-219266 | 8/2007 |
| JP | 2009-122387 | 6/2009 |

* cited by examiner

*Primary Examiner* — Walter L Lindsay, Jr.
*Assistant Examiner* — Benjamin Schmitt
(74) *Attorney, Agent, or Firm* — Smith, Gambrell & Russell, LLP

(57) ABSTRACT

An color image forming apparatus 1 has photosensitive units 5 and developing units 6 that can be drawn out of an apparatus main body along a direction of a photosensitive drum 15 and has an intermediate transfer unit 7 that can be drawn out of the apparatus main body along a moving direction of an intermediate transfer belt 10. The color image forming apparatus 1 includes a pressing release mechanism 41 that releases pressing against the photosensitive drum 15 by a primary transfer roller 8 in conjunction with an operation required at a time of drawing out any of the photosensitive unit 5, the developing unit 6, and the intermediate transfer unit 7.

9 Claims, 7 Drawing Sheets

IMAGE FORMING APPARATUS

This application is based upon and claims the benefit of priority from the corresponding Japanese Patent Application No. 2010-041941 filed on Feb. 26, 2010, the entire contents of which are incorporated herein by reference.

BACKGROUND OF THE INVENTION

1. Field of the Invention

The present invention relates to an image forming apparatus applied to any of a copier, a printer, a facsimile, or a MFP composed of these machines, all of which transfer a toner image onto paper through a xerographic technique, and more specifically to a tandem-type image forming apparatus that transfers a color image by use of an intermediate transfer unit.

2. Description of Related Art

A tandem type color image forming apparatus is structured to have a plurality of photosensitive drums arranged along a moving direction of an intermediate transfer belt, and transfers onto the intermediate transfer belt toner images of respective colors formed on the photosensitive drums and then transfers them from the intermediate transfer belt onto paper. In this image forming apparatus, (for the transfer of the toner images on the photosensitive drums onto the intermediate transfer belt), primary transfer rollers press the intermediate transfer belt against the photosensitive drums. Moreover, the tandem type color image forming apparatus is provided in: a mode of a photosensitive unit having the photosensitive drum assembled with a charging device that charges a surface of the photosensitive drum; and a mode of an intermediate transfer unit having the intermediate transfer belt stretched over a driving roller, a driven roller, and a primary transfer roller, and therefore upon replacement of the photosensitive drum or the intermediate transfer belt, the replacement is done on an individual unit basis.

In the unit replacement, it is preferable that directions in which the photosensitive unit and the intermediate transfer unit are drawn out be different from each other since it decreases aperture parts of the apparatus main body to increase rigidity and also improve image quality. Therefore, provided is a structure such that the photosensitive unit can be drawn out along an axial direction of the photosensitive drum and the intermediate transfer unit can be drawn out along a moving direction of the intermediate transfer belt.

Upon the replacement of the photosensitive unit and the intermediate transfer unit described above, for the purpose of avoiding scratch of the photosensitive drum and the intermediate transfer belt, the pressing against the photosensitive drum side by the primary transfer roller needs to be released. Thus, conventionally known is an image forming apparatus which vertically moves, in conjunction with opening and closing of a front door, an entire intermediate transfer unit including an intermediate transfer belt and a primary transfer roller, which vertically moves and tilts a right side of the intermediate transfer unit in conjunction with opening and closing of a right side door, and which vertically moves and tilts a left side of the intermediate transfer unit in conjunction with opening and closing of a left side door.

However, the conventional image forming apparatus requires: a conversion mechanism that converts opening and closing operation into operation of vertically moving and tilting the entire intermediate transfer unit; and a driving mechanism that vertically moves and tilts the entire intermediate transfer unit. Thus, an extensive and complicated structure results, bringing about a problem that assembly is a hard task.

SUMMARY OF THE INVENTION

It is an object of the present invention to provide an image forming apparatus that can release pressing by a primary transfer roller with a simply structure and that is easily assembled.

In order to achieve the object described above, an image forming apparatus includes in an apparatus main body: a photosensitive unit having a photosensitive drum on which a toner image is formed; a developing unit supplying a toner to the photosensitive unit; and an intermediate transfer unit having: an intermediate belt onto which the toner image on the photosensitive unit is transferred, and a primary transfer roller pressing the intermediate transfer belt against the photosensitive unit, wherein at least one of the photosensitive unit and the developing unit can be drawn out of the apparatus main body along an axial direction of the photosensitive drum, and the intermediate transfer unit can be drawn out of the apparatus main body along a moving direction of the intermediate transfer unit, and wherein a pressing release mechanism is provided which releases the pressing against the photosensitive drum by the primary transfer roller in conjunction with operation required at time of drawing out any of the photosensitive unit, the developing unit, and the intermediate transfer unit.

In a preferred embodiment of the invention, the apparatus main body includes: an openable and closable first cover door being opened at the time of drawing out at least one of the photosensitive unit and the developing unit; and an openable and closable second cover door being opened at the time of drawing out the intermediate transfer unit, and the pressing release mechanism releases the pressing against the photosensitive drum by the primary transfer roller in conjunction with the opening of either of the first cover door and the second cover door.

In the preferred embodiment of the invention, in conjunction with closing of either of the first cover door and the second cover door, the pressing release mechanism brings about a state in which the primary transfer roller is pressing against the photosensitive drum.

In the preferred embodiment of the invention, the pressing release mechanism includes: a pressing member pressing the primary transfer roller against the photosensitive unit; and a release member releasing the pressing by the pressing member following the opening of either of the first cover door and the second cover door.

In the preferred embodiment of the invention, the pressing member includes: a pressing shaft biased in such a manner as to be movable towards the first cover door; and a support holder coupled to the pressing shaft in such a manner as to be capable of moving to approach or separate from the primary transfer roller, the support holder supporting the primary transfer roller to thereby press the primary transfer roller against the photosensitive drum. The release member includes a slider provided between the pressing shaft and the first cover door to stop movement of the pressing shaft. The slider permits movement of the pressing shaft towards the first cover door as a result of the opening of the first cover door, the movement causing the movement of the support holder whereby the primary transfer roller separates from the abutted photosensitive drum.

In the preferred embodiment of the invention, the pressing member includes: a pressing shaft biased in such a manner as to be movable towards the first cover door; and a support holder coupled to the pressing shaft in such a manner as to be capable of moving to approach or separate from the primary transfer roller, the support holder supporting the primary transfer roller to thereby press the primary transfer roller against the photosensitive drum. The release member includes a slider being slidable in the moving direction of the intermediate transfer belt while provided between the pressing shaft and the first cover door. A concave part and a convex part to engage with the first cover door are formed at the slider. When the convex part has engaged with the first cover door, the movement of the pressing shaft is stopped, and when the concave part has engaged with the first cover door, the movement of the pressing shaft towards the first cover door is permitted, the movement causing the support holder to separate from the abutted primary transfer roller.

In the preferred embodiment of the invention, the slider is slid in conjunction with the opening and closing of the second cover door.

In the preferred embodiment of the invention, the slider is manually slid independently from the opening and closing of the second cover door.

Further features and advantages of the present invention will become apparent from the description of embodiments given below.

DETAILED DESCRIPTION OF PREFERRED EMBODIMENTS

An image forming apparatus according to one embodiment of the present invention will be described with reference to the accompanying drawings.

Figure 1:
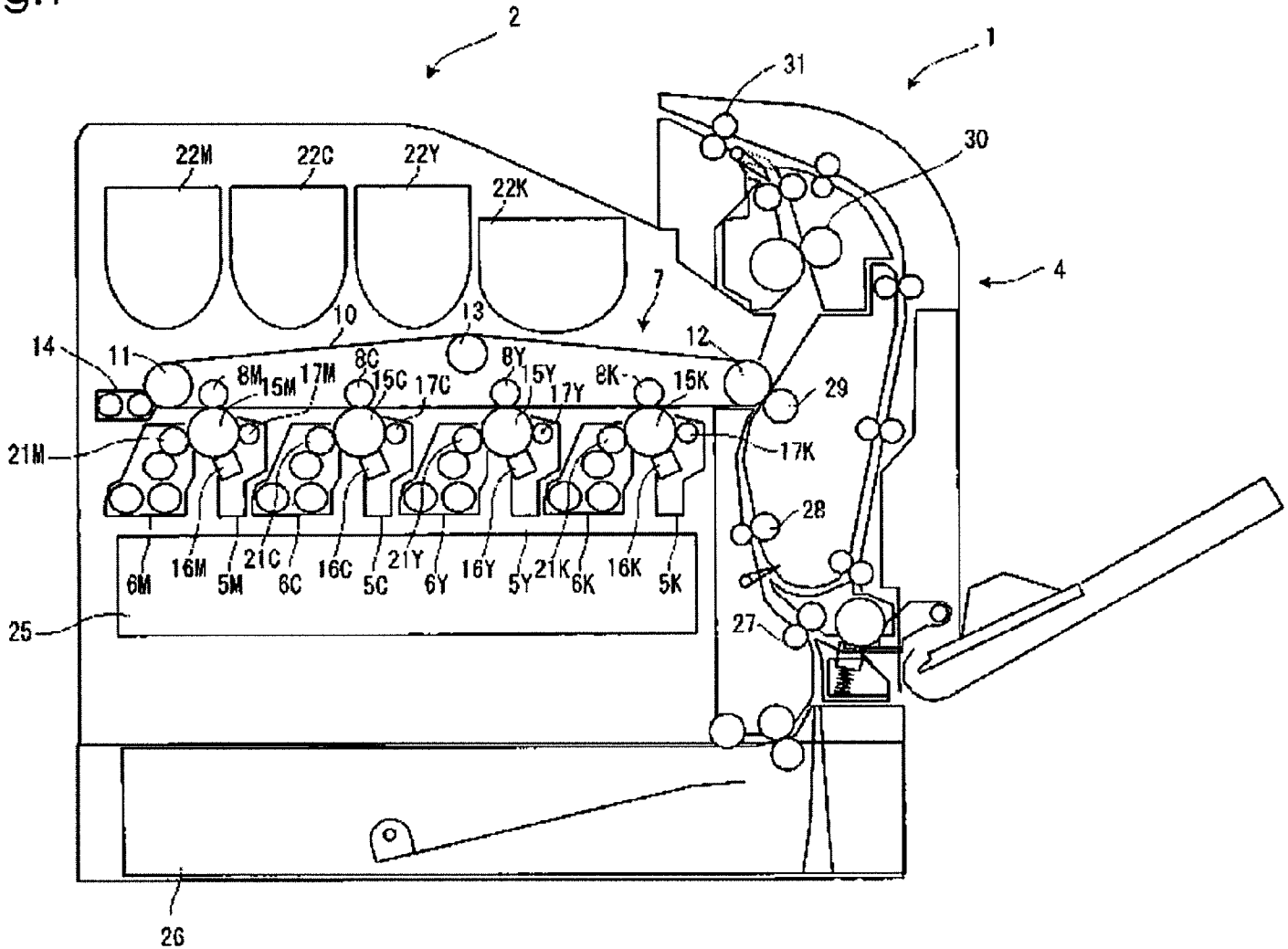
FIG. 1 is a sectional view showing inner structure of an image forming apparatus according to one embodiment of the present invention.
Figure 2:
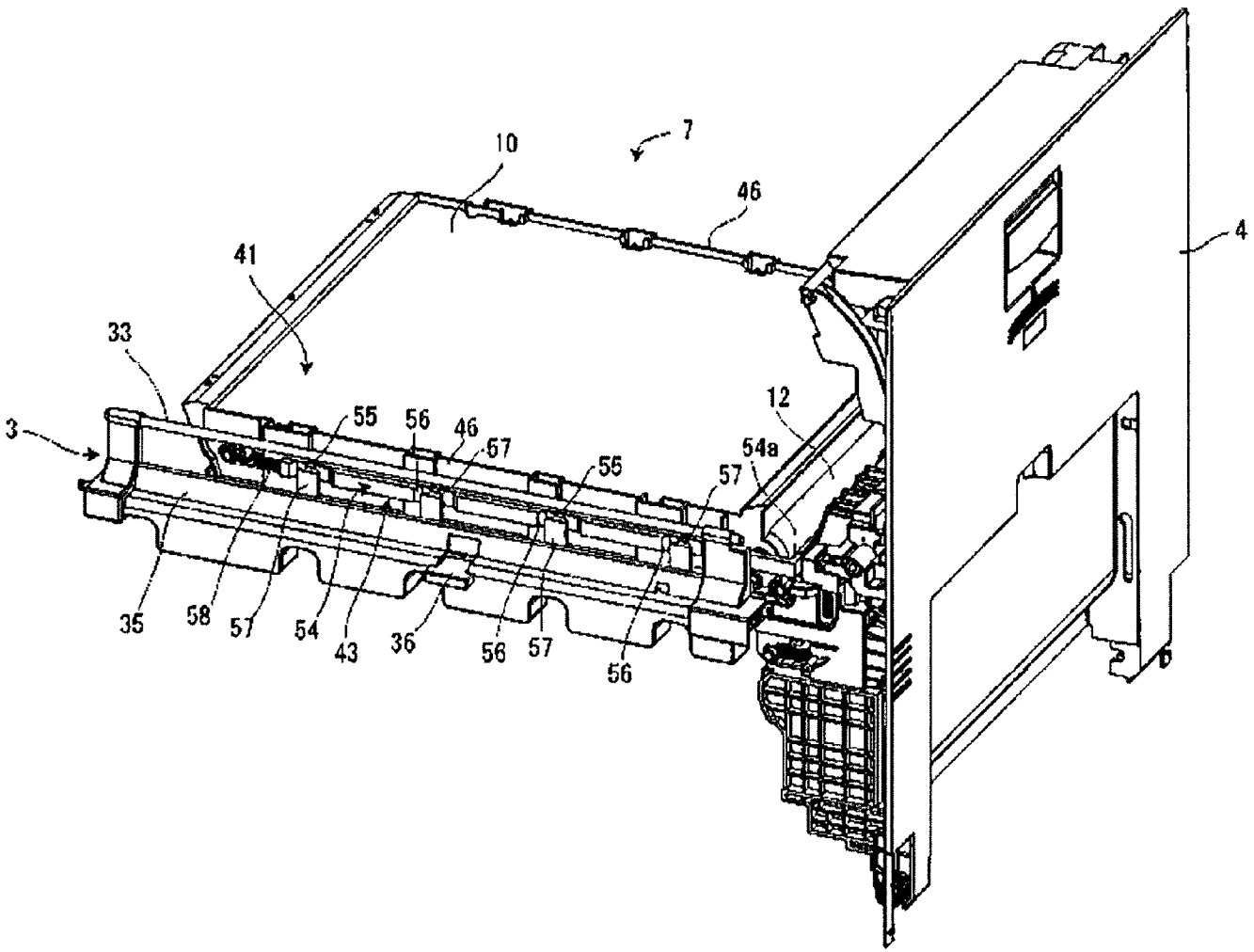
FIG. 2 is a perspective view showing surroundings of an intermediate transfer unit of the image forming apparatus according to one embodiment of the invention.
Figure 3A:
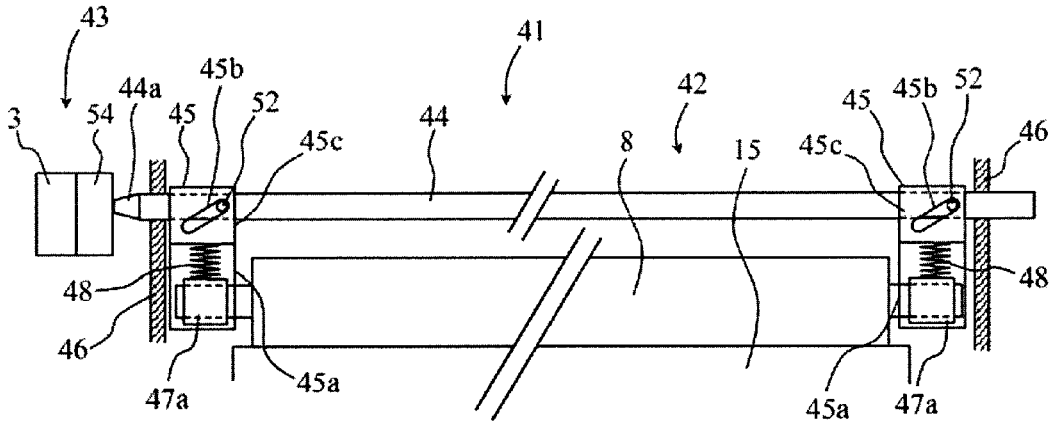
FIG. 3A is an elevation view showing a state of pressing by a pressing release mechanism of the image forming apparatus according to one embodiment of the invention.
Figure 3B:
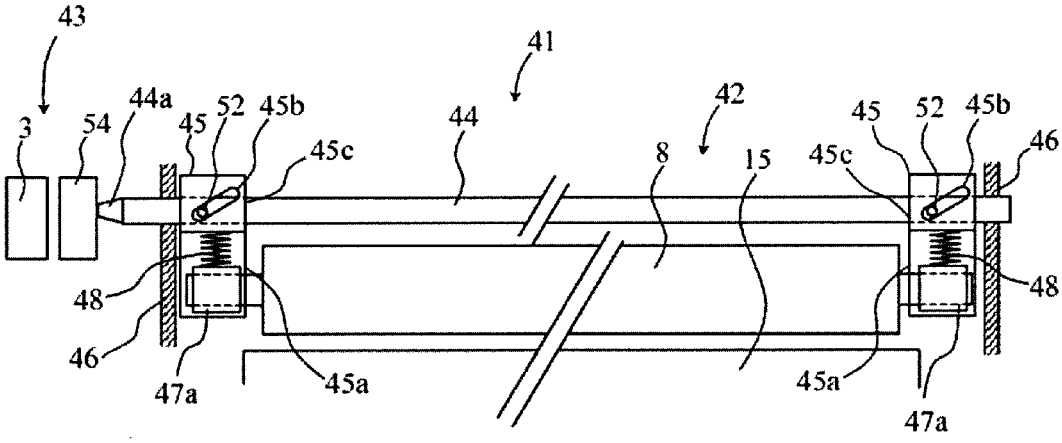
FIG. 3B is an elevation view showing a state of releasing pressing by the pressing release mechanism of the image forming apparatus according to one embodiment of the invention.
Figure 4:
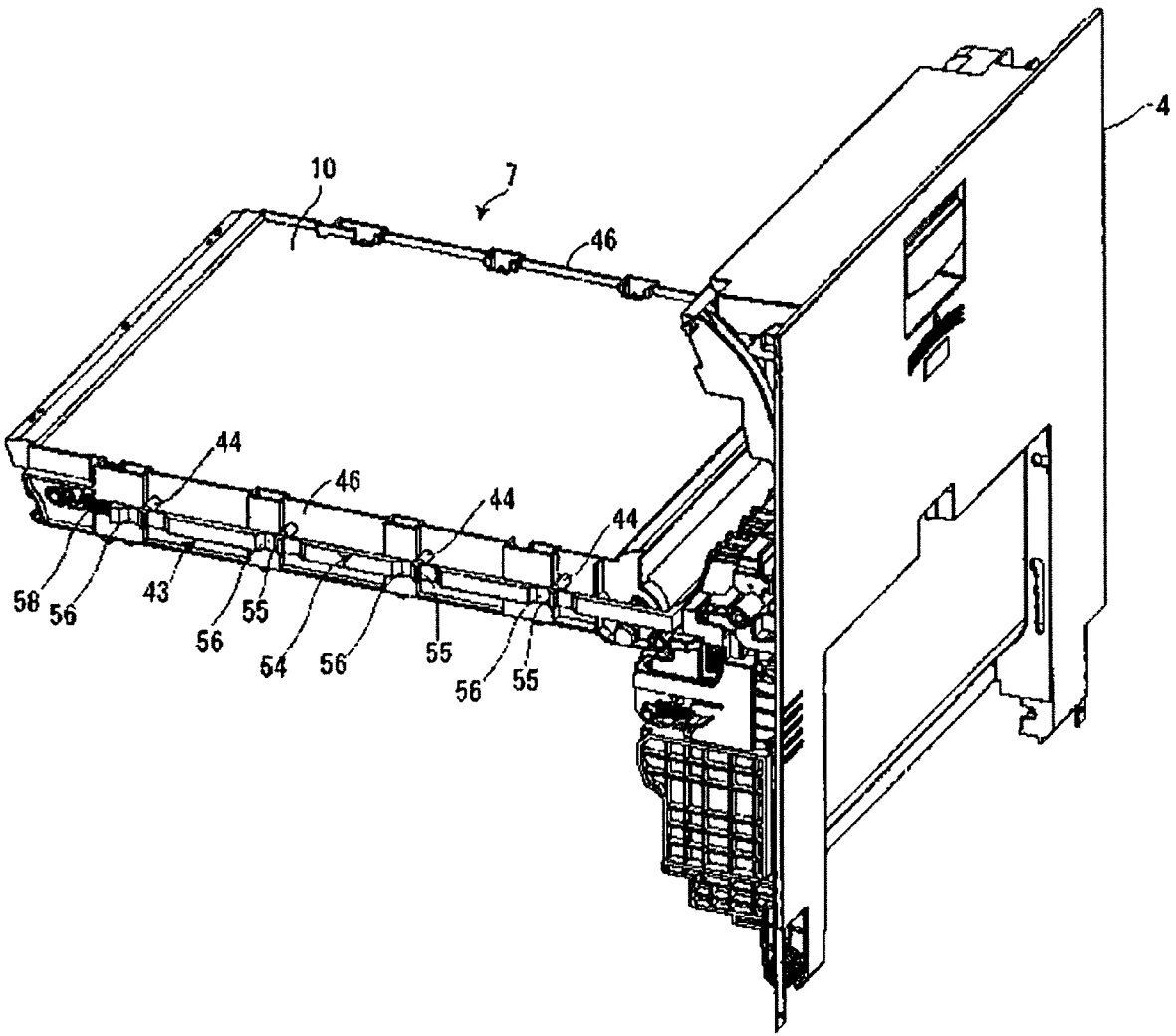
FIG. 4 is a perspective view showing a state when a photosensitive unit and a developing unit are drawn out of the image forming apparatus according to one embodiment of the invention.
Figure 6:
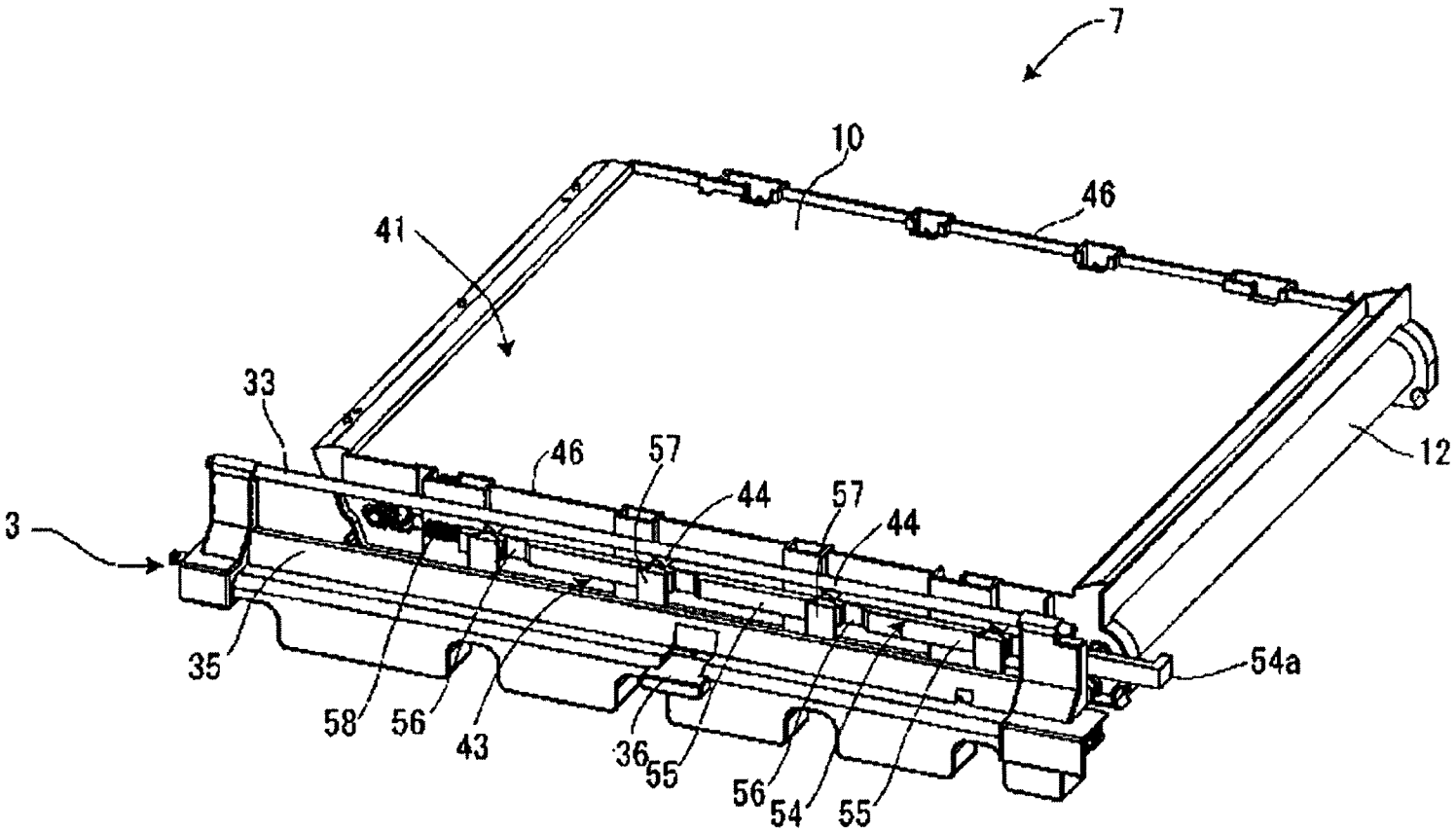
FIG. 6 is a perspective view showing a state when the intermediate transfer unit is drawn out of the image forming apparatus according to one embodiment of the invention.
Figure 7:
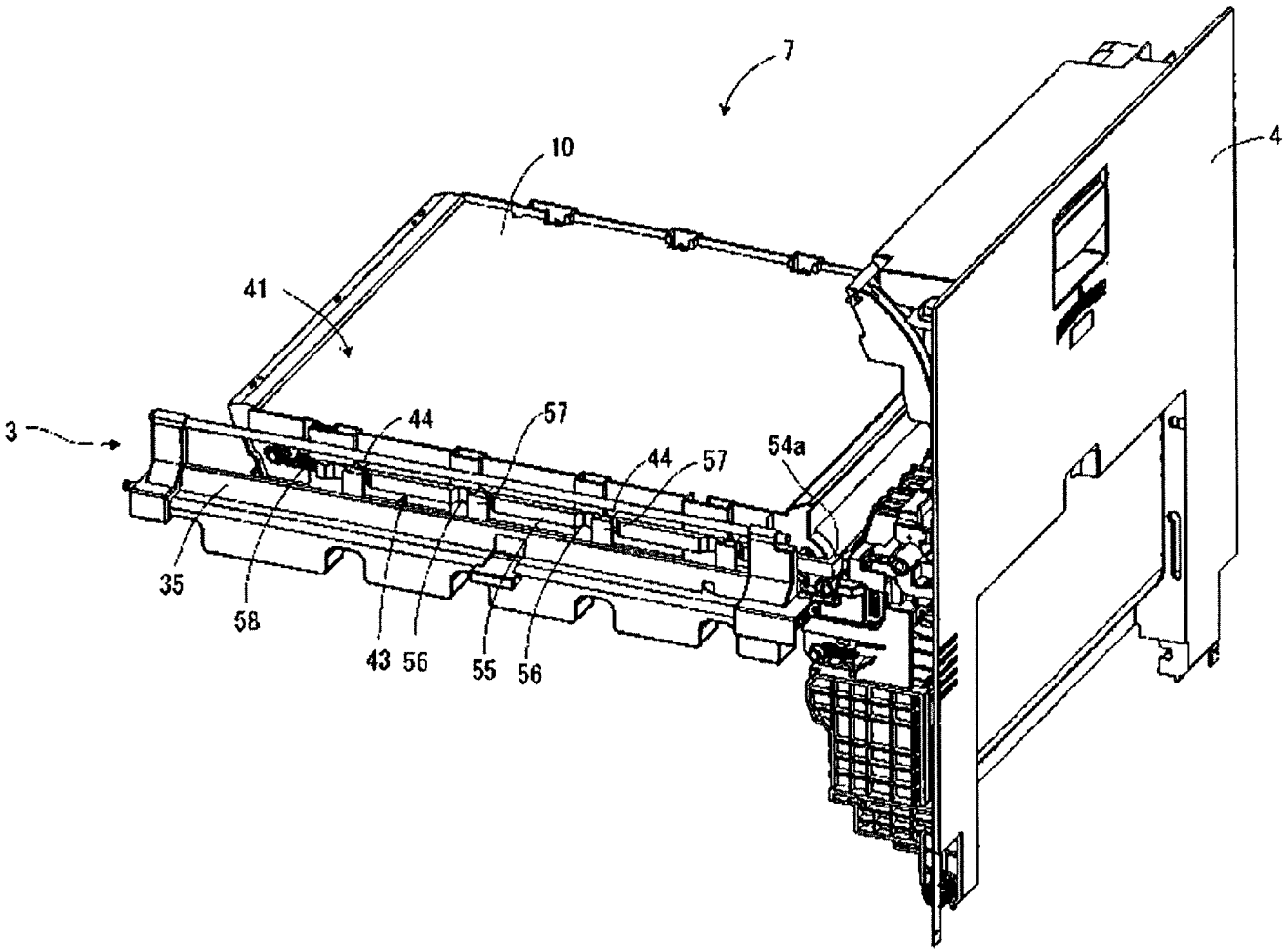
FIG. 7 is a perspective view showing a state when pressing by a primary transfer roller is manually released in the image forming apparatus according to one embodiment of the invention.

FIG. 1 is a sectional view showing inner structure of a tandem-type color image forming apparatus as an image forming apparatus according to one embodiment of the invention; FIG. 2 is a perspective view showing surroundings of an intermediate transfer unit; FIGS. 3A and 3B are elevation views showing a pressing release mechanism; FIG. 4 is a perspective view showing a state when a photosensitive unit or a developing unit is drawn out; FIGS. 5A to 5D are plan views showing operation of the image forming apparatus; FIG. 6 is a perspective view showing a state when the intermediate transfer unit is drawn out; and FIG. 7 is a perspective view showing a state when pressing by a primary transfer roller is manually released.

As shown in FIG. 1, the tandem type color image forming apparatus 1 includes an apparatus main body 2, which has a first cover door 3 (see FIG. 2) provided at its front surface in an openable and closable manner and has a second cover door 4 provided at its one side surface (right side surface) in an openable and closable manner.

As shown in FIG. 1, provided inside the apparatus main body 2 are: a plurality of photosensitive units 5M, 5C, 5Y, and 5K respectively corresponding to magenta (M), cyan (C), yellow (Y), and black (K) colors; developing units 6M, 6C, 6Y, and 6K respectively corresponding to the photosensitive units 5M, 5C, 5Y, and 5K; and an intermediate transfer unit 7.

The intermediate transfer unit 7 has: a driving roller 11; a driven roller 12; a tension roller 13; an intermediate transfer belt 10 endlessly stretched over these rollers; and a plurality of primary transfer rollers 8M, 8C, 8Y, and 8K. The intermediate transfer belt 10 can be moved by rotation of the driving roller 11. Provided on a side of the driving roller 11 is a cleaning device 14 that cleans the intermediate transfer belt 10. Entire such an intermediate transfer unit 7 can be drawn out of the apparatus main body 2 along a moving direction of the intermediate transfer belt 10.

The primary transfer rollers 8M, 8C, 8Y, and 8K are respectively provided in correspondence with photosensitive drums 15M, 15C, 15Y, and 15K in such a manner as to be located inside of the endless intermediate transfer belt 10. Respectively sandwiching the intermediate transfer belt 10 with the photosensitive drums 15M, 15C, 15Y, and 15K, the primary transfer rollers 8M, 8C, 8Y, and 8K press the intermediate transfer belt 10 against the photosensitive drums 15M, 15C, 15Y, and 15K. As a result of this pressing, toner images of the respective colors on the photosensitive drums 15M, 15C, 15Y, and 15K are sequentially transferred onto the intermediate transfer belt 10 whereby a full-color toner image is formed on the intermediate transfer belt 10.

Located below the intermediate transfer belt 10, the photosensitive units 5M, 5C, 5Y, and 5K are so arranged as to be aligned in order from an upstream side in the moving direction of the intermediate transfer belt 10. The photosensitive units 5M, 5C, 5Y, and 5K respectively include: the photosensitive drums 15M, 15C, 15Y, and 15K; charging devices 16M, 16C, 16Y, and 16K that respectively evenly charge surfaces of the photosensitive drums 15M, 15C, 15Y, and 15K; and cleaning rollers 17M, 17C, 17Y, and 17K that respectively clean the surfaces of the photosensitive drums 15M, 15C, 15Y, and 15K. Each of such photosensitive units 5M, 5C, 5Y, and 5K can be drawn out of the apparatus main body 2 along an axial direction of the photosensitive drums 15M, 15C, 15Y, and 15K.

The developing units 6M, 6C, 6Y, and 6K are respectively provided closely to the photosensitive units 5M, 5C, 5Y, and 5K, and respectively have developing rollers 21M, 21C, 21Y, and 21K that respectively supply toners of the respective colors to the photosensitive drums 15M, 15C, 15Y, and 15K. To the developing units 6M, 6C, 6Y, and 6K, the toners of the respective colors are supplied from toner containers 22M, 22C, 22Y, and 22K provided in the apparatus main body 2. Similarly to the photosensitive units 5M, 5C, 5Y, and 5K, the developing units 6M, 6C, 6Y, and 6K can be drawn out of the apparatus main body 2 along the axial direction of the photosensitive drums 15M, 15C, 15Y, and 15K. Note that those which are respectively integrated with the photosensitive units 5M, 5C, 5Y, and 5K and which can be drawn out of the apparatus main body 2 integrally with the photosensitive units 5M, 5C, 5Y, and 5K are permitted as the developing units 6M, 6C, 6Y, and 6K.

Color image formation performed by the color image forming apparatus 1 described above will be described below. Additional characters M, C, Y, and K will be omitted when the respective colors are collectively described below. As shown in FIG. 1, arranged on the second cover door 4 side are: conveying rollers 27; a registration roller pair 28; a secondary transfer roller 29; a fixing device 30; and discharge rollers 31, all of which form a paper conveyance path. Arranged at the bottom of the apparatus main body 2 is a paper feed cassette 26.

On each of the photosensitive drums 15 whose surfaces are evenly charged by the charging devices 16, exposure is performed by an exposure unit 25 whereby electrostatic latent images are formed on the surfaces of the respective photosensitive drums 15. Then the electrostatic latent images on the respective photosensitive drums 15 are developed by the developing units 6 whereby the toner images of the respective colors are formed. The toner images on the respective photosensitive drums 15 are sequentially transferred onto the intermediate transfer belt 10 that is pressed against the photosensitive drums 15 by the primary transfer rollers 8. Consequently, the full-color toner image is formed on the intermediate transfer belt 10.

On the other hand, paper is taken out from the paper feed cassette 26. The taken-out paper is conveyed to the registration roller pair 28 by the conveying rollers 27. The secondary transfer roller 29 is in contact with the intermediate transfer belt 10 on a downstream side of the registration roller pair 28. In synchronization with timing at which the toner image on the intermediate transfer belt 10 reaches the secondary transfer roller 29, the registration roller pair 28 conveys the paper. Thus, the full-color toner image on the intermediate transfer belt 10 is transferred onto the paper by the secondary transfer roller 29. Then the paper is conveyed to the fixing device 30, where the paper is heated and pressurized by the fixing device 30 whereby the full-color toner image is fixed onto the paper. Then the paper is discharged to outside of the apparatus main body 2 by the discharge rollers 31.

Next, structure that permits release of the pressing against the photosensitive drums 15 by the intermediate transfer rollers 8 will be described.

As shown in FIG. 2, the second cover door 4 on the right side surface of the apparatus main body 2 is provided in the moving direction of the intermediate transfer belt 10, and is opened upon drawing the entire intermediate transfer unit 7 out of the apparatus main body 2. The opening of the second cover door 4 is achieved by rightward turning of its top part around a spindle extending horizontally (in an anteroposterior direction in FIG. 2) at the bottom of the apparatus main body 2. The opening of the second cover door 4 brings about a state in which respective rollers of the conveying rollers 27, the registration roller pair 28, the fixing device 30, and the discharge rollers 31 (all located on the second cover door 4 side), and the secondary transfer roller 29 are separated from the apparatus main body 2. Therefore, moving the entire intermediate transfer unit 7 along the moving direction of the intermediate transfer belt 10 permits the intermediate transfer unit 7 to be drawn out through an opening portion of the second cover door 4.

The first cover door 3 on the front surface of the apparatus main body 2 is provided on a tip side in the axial direction of the photosensitive drums 15, and is opened upon drawing the photosensitive units 5 out of the apparatus main body 2. The opening of the first cover door 3 is achieved by turning of its lower end side around a spindle 33 extending laterally, and the first cover door 3 is opened longitudinally. Note that the first cover door 3 is arranged on an inner side of an openable and closable cover body that covers the front surface of the apparatus main body 2, but the cover body that covers the front surface of the apparatus main body 2 is omitted in FIGS. 2, 4, 6, and 7. The first cover door 3 has a frame member 35 provided with: a positioning part that positions axes of the photosensitive units 15 with respect to the apparatus main body 2; etc. The frame member 35 is provided with a control lever 36 for controlling a hook engaging with the apparatus main body 2. Turning the control lever 36 upward releases the engagement between the hook and the apparatus main body 2, and the frame member 35 turns upward about the spindle 33. Consequently, the frame member 35 retracts from axial lines of the photosensitive drums 15 and the first cover door 3 is opened, so that the photosensitive units 5 or the developing units 6 can be drawn out through the opening portion.

FIG. 3 show a pressing release mechanism 41 that releases the pressing against the photosensitive drum 15 by the primary transfer roller 8. The pressing release mechanism 41 includes: a pressing member 42 that presses the primary transfer roller 8 against the photosensitive drum 15; and a release member 43 that releases the pressing by the pressing member 42.

The pressing members 42 are members that press the respective primary transfer rollers 8 (8M, 8C, 8Y, and 8K) against the photosensitive drums 15 (15M, 15C, 15Y, and 15K), and are provided respectively in correspondence with the primary transfer rollers 8 (8M, 8C, 8Y, and 8K). Each of the pressing members 42 is formed with a pressing shaft 44 and a support holder 45.

The pressing shaft 44 is provided on an upper side of the primary transfer roller 8 in a manner such as to be substantially parallel to the primary transfer roller 8. Moreover, the pressing shaft 44 extends along the axial direction of the photosensitive drum 15 (axial direction of the primary transfer roller 8), and has its both end parts stretched over a unit frame 46 of the intermediate transfer unit 7 and is thereby supported by the unit frame 46. The pressing shaft 44 is biased by a spring (not shown) in a manner such as to be movable towards the first cover door 3 (in a leftward direction in FIG. 3). Under a state in which the pressing shaft 44 is fitted to the unit frames 46, a tip part 44*a* of the pressing shaft 44 protrudes outwardly from one of the unit frames 46 (the one on a left side in FIG. 3), as a result of which the tip part 44*a* faces a slider 54 to be described below (see FIGS. 2, 4, 6, and 7).

On the other hand, the primary transfer roller 8 has bearing members 47 fitted to its both axial end parts. Each of the bearing members 47 is supported by a support holder 45 while biased downwardly by a spring 48. The support holder 45 is supported inside of the unit frame 46 in such a manner as to be movable vertically. Therefore, the primary transfer roller 8 is vertically movable together with the support holders 45, and makes contact with the intermediate transfer belt 10 located therebelow as a result of downward movement of the support holders 45 and presses against the photosensitive drum 15 by the spring 48. On the contrary, moving upward together with the support holder 45, the primary transfer roller 8 separates from the photosensitive drum 15 whereby the pressing is released.

The support holders 45 are fitted in pair to the unit frames 46 in such a manner as to support a roller axis at both ends of the primary transfer roller 8. The fitting of the support holders 45 to the unit frames 46 is achieved by inserting body parts 45*a* of the support holders 45 into groove parts (not shown) formed at the unit frames 46. Integrally formed at a top part of the body part 45*a* of each support holder 45 is a cam part 45*c* having a elongated hole 45*b* so formed as to extend in a drum axis direction while tilted vertically. This elongated hole 45*b* tilts upward gradually in a direction separating from the tip part 44*a* of the pressing shaft 44 (in a rightward direction in FIG. 3A and FIG. 3B). Pins 52 of the pressing shaft 44 are inserted into the elongated holes 45*b* whereby the support holders 45 are coupled to the pressing shaft 44. When the pressing shaft 44 is moved rightward by the first cover door 3 and the release member, as shown in FIG. 3A, the pins 52 move closely to right ends of the elongated holes 45*b*, thus bringing a state in which the support holders 45 have moved downward. Consequently, the primary transfer roller 8 presses against the photosensitive drum 15. On the contrary, when the pressing shaft 44 is moved towards the first cover door 3 by a spring bias force, as shown in FIG. 3B, the pins 52 move closely to left ends of the elongated holes 45*b*, thus bringing about a state in which the support holders 45 has moved upward. In this state, the pressing against the photosensitive drum 15 by the primary transfer roller 8 is released.

The release member 43 in the pressing release mechanism 41 is a member that releases the pressing against the photosensitive drum 15 by the primary transfer roller 8 achieved by the pressing member 42 described above. As shown in FIG. 2, the release member 43 is formed with a slider 54 fitted to the intermediate transfer unit 7.

As shown in FIGS. 2, 4, 6, and 7, the slider 54 is arranged in such a manner as to extend laterally on a front side of the intermediate transfer unit 7. Moreover, as shown in FIGS. 2, 3A, and 3B, the slider 54 is provided between the first cover door 3 and the tip part 44*a* of the pressing shaft 44 and thus sandwiched between the first cover door 3 and the pressing shaft 44. Furthermore, the slider 54 is movable towards the first cover door 3, and as a result of its movement toward the first cover door 3, the slider 54 can separate from the tip part 44*a* of the pressing shaft 44. As a result of the separation of the slider 54 from the tip part 44*a* of the pressing shaft 44, the pressing shaft 44 is moved towards the first cover door 3 by the spring bias force.

In this embodiment, the slider 54 is further reciprocally slidable along the moving direction of the intermediate transfer belt 10 (laterally). The sliding of the slider 54 along the moving direction of the intermediate transfer belt 10 is, as described below, performed manually or by a bias force of a sliding spring 58, and the sliding in an opposite direction is performed by closing of the second cover door 4. Formed at an end part located on a second cover door 4 side of the slider 54 is a bending part 54*a* to be pressed by the second cover door 4.

On a surface of the slider 54 opposing the first cover door 3 side, convex parts 55 and concave parts 56 are formed in a longitudinal direction in the slider 54 at predetermined intervals. In contrast, at the frame member 35 of the first cover door 3, engaging convex parts 57 are formed. The engaging convex parts 57 engage with the convex parts 55 or the concave parts 56 following the sliding of the slider 54. In a state in which the first cover door 3 is closed, the convex parts 55 of the slider 54 engage with the engaging convex parts 57 of the first cover door 3, thereby bringing about a state in which the slider 54 stops the movement of the pressing shafts 44 towards the first cover door 3. Therefore, each of the support holders 45 turns into the state of FIG. 3A, i.e., a state in which the primary transfer roller 8 is pressing against the photosensitive drum 15. On the other hand, when the concave parts 56 of the slider 54 engage with the engaging convex parts 57 following the sliding of the slider 54, the slider 54 is pressed by the pressing shafts 44 and thereby moves towards the first cover door 3. That is, the pressing shafts 44 move towards the first cover door 3 by the spring bias force, following which each of the support holders 45 turns into the state of FIG. 3B, so that the pressing against the photosensitive drum 15 by the primary transfer roller 8 is released. For smooth engagement between the engaging convex part 57 and the convex part 55 or the concave part 56 as a result of the sliding of the slider 54, a boundary portion between the convex part 55 and the concave part 56 of the slider 54 on one side (left side) is formed with a tapered surface 61, and in correspondence therewith, a tapered surface 62 is formed at the engaging convex part 57 (see FIGS. 5A to 5D).

As shown in FIGS. 2, 4, 6, and 7, the sliding spring 58 is provided on one end side (left end side) of the slider 54, and the slider 54 is biased by the sliding spring 58 in such a manner as to move towards the second cover door 4. This biasing permits the slider 54 to slide in conjunction with the opening of the second cover door 4, and based on this sliding, the pressing against the photosensitive drums 15 by the primary transfer rollers 8 is released. Thus, the release of the pressing by the primary transfer rollers 8 can be performed in conjunction with the opening of the second cover door 4.

Next, operation performed upon the release of the pressing by the primary transfer rollers 8 according to this embodiment will be described.

Figure 5A:
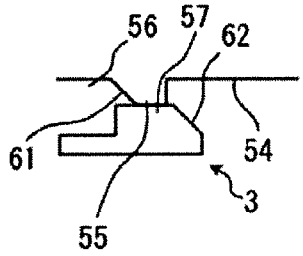
FIG. 5A is a plan view showing operation of the image forming apparatus according to one embodiment of the invention.

FIG. 5A shows a normal state in which the first cover door 3 and the second cover door 4 are closed. In the normal state, the engaging convex part 57 of the first cover door 3 and the convex part 55 of the slider 54 engage with each other, so that the slider 54 stops the movement of the pressing shaft 44 towards the first cover door 3. This therefore brings about a state in which the primary transfer roller 8 is pressing against the photosensitive drum 15, which permits image formation by the color image forming apparatus 1.

Figure 5B:
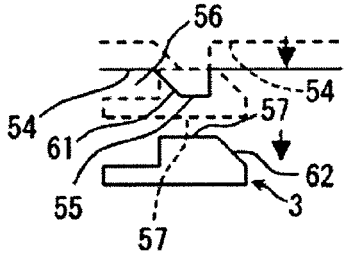
FIG. 5B is a plan view showing operation of the image forming apparatus according to one embodiment of the invention.

FIG. 5B shows a state in which the first cover door 3 is open for drawing the photosensitive unit 5 or the developing unit 6 out of the apparatus main body 2, and FIG. 4 is a perspective view corresponding thereto.

As a result of the opening of the first cover door 3, the engaging convex part 57 of the first cover door 3 separates from the convex part 55 of the slider 54 (a state shown by a solid line of FIG. 5B). Thus, the spring-biased pressing shaft 44 moves towards the first cover door 3 while pressing the slider 54. As a result of this movement, the support holders 45 move upward (the state of FIG. 3B), which therefore releases the pressing against photosensitive drum 15 by the primary transfer roller 8. Thus, the photosensitive unit 5 or the developing unit 6 can be drawn out of the apparatus main body. In such operation, the release of the pressing against the photosensitive drum 15 by the primary transfer roller 8 can be performed in conjunction with the opening of the first cover door 3.

In the state of FIG. 5B, when the first cover door 3 has been closed, the slider 54 is pressed in by the first cover door 3 and the pressing shaft 44 is pressed by the slider 54 to thereby move in a direction opposite to the first cover door 3, which restores the state of FIG. 5A. This restores the state in which the primary transfer roller 8 is pressing against the photosensitive drum 15. Therefore, the pressing against the photosensitive drum 15 by the primary transfer roller 8 can be performed in conjunction with the closing of the first cover door 3.

Figure 5C:
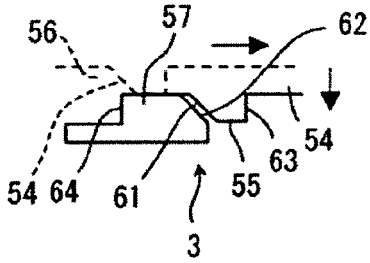
FIG. 5C is a plan view showing operation of the image forming apparatus according to one embodiment of the invention.

FIG. 5C shows a state in which the second cover door 4 is open for drawing the intermediate transfer unit 7 out of the apparatus main body 2, and FIG. 6 is a perspective view corresponding thereto.

As a result of the opening of the second cover door 4, the slider 54 is released from the state in which it is being pressed by the second cover door 4. Thus, the slider 54 is slid towards the second cover door 4 by the bias force of the sliding spring 58. That is, the slider 54 slides in conjunction with the opening of the second cover door 4. As a result of this sliding, the concave part 56 opposes the engaging convex part 57 of the first cover door 3. Thus, the spring-biased pressing shaft 44 moves towards the first cover door 3 while pressing the slider 54. For the slider 54 pressed by the pressing shaft 44, its concave part 56 engages with the engaging convex part 57 of the first cover door 3. Moreover, as a result of the movement of the pressing shaft 44, the support holders 45 move upward (the state of FIG. 3B), which therefore releases the pressing against the photosensitive drum 15 by the primary transfer roller 8. Therefore, the intermediate transfer unit 7 can be drawn out of the apparatus main body 2. In such operation, the release of the pressing against the photosensitive drum 15 by the primary transfer roller 8 can be performed in conjunction with the opening of the second cover door 4.

In the state of FIG. 5C, when the second cover door 4 has been closed, the second cover door 4 presses the bending part 54*a*, so that the slider 54 is slid in a direction opposite to the second cover door 4 by the second cover door 4. That is, the slider 54 slides in conjunction with the closing of the second cover door 4. As a result of this sliding, the convex part 55 engages with the engaging convex part 57 of the first cover door 3, so that the slider 54 is pressed in by the first cover door 3 and the pressing shaft 44 is pressed by the slider 54. Thus, the pressing shaft 44 moves in the direction opposite to the first cover door 3, which restores the state of FIG. 5A. This restores the state in which the primary transfer roller 8 is pressing against the photosensitive drum 15. Therefore, the pressing against the photosensitive drum 15 by the primary transfer roller 8 can be performed in conjunction with the closing of the second cover door 4.

Figure 5D:
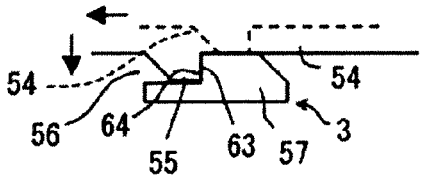
FIG. 5D is a plan view showing operation of the image forming apparatus according to one embodiment of the invention.

FIG. 5D shows operation of manually releasing the pressing against the photosensitive drum 15 by the primary transfer roller 8, and FIG. 7 is a perspective view corresponding thereto.

In FIG. 5D, the slider 54 is manually slid in a direction opposite to the second cover door 4 (leftward) in the normal state of FIG. 5A. To perform this manual sliding, a lever (not shown) is provided on a left-side end part of the slider 54 and this lever is manually pulled to the left, or the bending part 54*a* at a right end part of the slider 54 is manually pulled in. As a result of the manual leftward sliding of the slider 54, the concave part 56 of the slider 54 faces the engaging convex part 57 of the first cover door 3. Thus, the spring-biased pressing shaft 44 moves towards the first cover door 3 while pressing the slider 54. For the slider 54 pressed by the pressing shaft 44, its concave part 56 engages with the engaging convex part 57 of the first cover door 3. Moreover, as a result of the movement of the pressing shaft 44, the support holders 45 move upward (the state of FIG. 3B), which therefore releases the pressing against the photosensitive drum 15 by the primary transfer roller 8.

To maintain this state in which the concave part 56 and the engaging convex part 57 engage with each other, as shown in FIGS. 5C and 5D, a boundary portion between the convex part 55 of the slider 54 and the other side (right side) of the concave part 56 is formed with a locked surface 63 that is bent orthogonally, and at the engaging convex part 57 corresponding thereto, a locked surface 64 that is bent orthogonally is formed. In a state in which these locked surfaces 63 and 64 engage with each other, the engagement between the slider 54 and the first cover door 3 is never released. Therefore, the state in which the pressing by the primary transfer roller 8 is released can be maintained for a long period of time, which can avoid deformation caused by the photosensitive drum 15 as a result of the pressing by the primary transfer roller 8 at shipment from a factory or at long-term storage.

Under the state of FIG. 5D, when the first cover door 3 has been opened, the engaging convex part 57 disengages from the concave part 56, so that the slider 54 returns to its original position (the state shown by a broken line of FIG. 5D) by the bias force of the sliding spring 58. Thus, subsequently closing the first cover door 3 brings about the state of FIG. 5A. That is, the engaging convex part 57 of the first cover door 3 and the convex part 55 of the slider 54 engage with each other, pressing in the pressing shaft 44, so that the support holders 45 move downward, resulting in the state of FIG. 3A, which brings about the state in which the primary transfer roller 8 is pressing against the photosensitive drum 15. This state is the normal state, which permits the image formation by the color image forming apparatus 1.

According to the embodiment described above, the pressing release mechanism 41 that releases the pressing against the photosensitive drum 15 by the primary transfer roller 8 is formed with the pressing shaft 44, the support holders 45, and the slider 54, and therefore the pressing by the primary transfer roller 8 can be released with a simple structure. This can provide an image forming apparatus that is easily assembled.

Note that in the embodiment described above, the pressing by the primary transfer rollers 8M, 8C, 8Y, and 8K corresponding to the respective colors is released, but the pressing of at least one of the primary transfer rollers may be released.

What is claimed is:

1. An image forming apparatus comprising, in an apparatus main body:

a photosensitive unit having a photosensitive drum on which a toner image is formed;

a developing unit supplying a toner to the photosensitive unit;

an intermediate transfer unit having an intermediate belt onto which the toner image on the photosensitive unit is transferred, and a primary transfer roller pressing the intermediate transfer belt against the photosensitive unit;

an openable and closable first cover door being opened at the time of drawing out at least one of the photosensitive unit and the developing unit;

an openable and closable second cover door being opened at the time of drawing out the intermediate transfer unit, wherein at least one of the photosensitive unit and the developing unit can be drawn out of the apparatus main body along an axial direction of the photosensitive drum, and the intermediate transfer unit can be drawn out of the apparatus main body along a moving direction of the intermediate transfer unit, wherein a pressing release mechanism is provided which releases the pressing against the photosensitive drum by the primary transfer roller in conjunction with an operation required at a time of drawing out any of the photosensitive unit, the developing unit, and the intermediate transfer unit, wherein the pressing release mechanism releases the pressing against the photosensitive drum by the primary transfer roller in conjunction with the opening of either of the first cover door or the second cover door, wherein the pressing release mechanism includes a pressing member pressing the primary transfer roller against the photosensitive unit, and a release member releasing the pressing by the pressing member following the opening of either of the first cover door or the second cover door, wherein the pressing member includes a pressing shaft biased in such a manner as to be movable towards the first cover door, and a support holder coupled to the pressing shaft in such a manner as to be capable of moving to approach or separate from the primary transfer roller, the support holder supporting the primary transfer roller to thereby press the primary transfer roller against the photosensitive drum, wherein the release member includes a slider provided between the pressing shaft and the first cover door to stop movement of the pressing shaft, and wherein the slider permits movement of the pressing shaft towards the first cover door as a result of the opening of the first cover door, the movement causing the movement of the support holder whereby the primary transfer roller separates from the abutted photosensitive drum.

2. An image forming apparatus comprising, in an apparatus main body:

a photosensitive unit having a photosensitive drum on which a toner image is formed;

a developing unit supplying a toner to the photosensitive unit;

an intermediate transfer unit having an intermediate belt onto which the toner image on the photosensitive unit is transferred, and a primary transfer roller pressing the intermediate transfer belt against the photosensitive unit;

an openable and closable first cover door being opened at the time of drawing out at least one of the photosensitive unit and the developing unit; and an openable and closable second cover door being opened at the time of drawing out the intermediate transfer unit, wherein at least one of the photosensitive unit and the developing unit can be drawn out of the apparatus main body along an axial direction of the photosensitive drum, and the intermediate transfer unit can be drawn out of the apparatus main body along a moving direction of the intermediate transfer unit, wherein a pressing release mechanism is provided which releases the pressing against the photosensitive drum by the primary transfer roller in conjunction with an operation required at a time of drawing out any of the photosensitive unit, the developing unit, and the intermediate transfer unit, wherein the pressing release mechanism releases the pressing against the photosensitive drum by the primary transfer roller in conjunction with the opening of either of the first cover door or the second cover door, wherein the pressing release mechanism includes a pressing member pressing the primary transfer roller against the photosensitive unit, and a release member releasing the pressing by the pressing member following the opening of either of the first cover door or the second cover door, wherein the pressing member includes a pressing shaft biased in such a manner as to be movable towards the first cover door, and a support holder coupled to the pressing shaft in such a manner as to be capable of moving to approach or separate from the primary transfer roller, the support holder supporting the primary transfer roller to thereby press the primary transfer roller against the photosensitive drum, wherein the release member includes a slider being slidable in the moving direction of the intermediate transfer belt while provided between the pressing shaft and the first cover door, wherein a concave part and a convex part to engage with the first cover door are formed at the slider, and wherein when the convex part has engaged with the first cover door, the movement of the pressing shaft is stopped, and when the concave part has engaged with the first cover door, the movement of the pressing shaft towards the first cover door is permitted, the movement causing the support holder to separate from the abutted primary transfer roller.

3. The image forming apparatus according to claim 2, wherein the slider is slid in conjunction with the opening and closing of the second cover door.

4. The image forming apparatus according to claim 2, wherein the slider manually is slid independently of the opening and closing of the second cover door.

5. The image forming apparatus according to claim 4, wherein when the slider has been slid, the concave part is locked in a state in which the concave part engages with the first cover door, and wherein as a result of an opening operation of the first cover door, the locking is released, the slider slides oppositely, and the convex part engages with the first cover door.

6. An image forming apparatus comprising, in an apparatus main body:

a photosensitive unit having a photosensitive drum on which a toner image is formed;

a developing unit supplying a toner to the photosensitive unit;

an intermediate transfer unit having an intermediate belt onto which the toner image on the photosensitive unit is transferred, and a primary transfer roller pressing the intermediate transfer belt against the photosensitive unit;

an openable and closable first cover door being opened at the time of drawing out at least one of the photosensitive unit and the developing unit; and an openable and closable second cover door being opened at the time of drawing out the intermediate transfer unit, wherein at least one of the photosensitive unit and the developing unit can be drawn out of the apparatus main body along an axial direction of the photosensitive drum, and the intermediate transfer unit can be drawn out of the apparatus main body along a moving direction of the intermediate transfer unit, wherein a pressing release mechanism is provided which releases the pressing against the photosensitive drum by the primary transfer roller in conjunction with an operation required at a time of drawing out any of the photosensitive unit, the developing unit, and the intermediate transfer unit, wherein the pressing release mechanism includes a pressing member pressing the primary transfer roller against the photosensitive unit, and a release member releasing the pressing by the pressing member following the opening of either of the first cover door or the second cover door, wherein the pressing release mechanism releases the pressing against the photosensitive drum by the primary transfer roller in conjunction with the opening of either of the first cover door or the second cover door, and brings about a state in which the primary transfer roller is pressing against the photosensitive drum in conjunction with closing of either of the first cover door or the second cover door, wherein the pressing member includes a pressing shaft biased in such a manner as to be movable towards the first cover door, and a support holder coupled to the pressing shaft in such a manner as to be capable of moving to approach or separate from the primary transfer roller, the support holder supporting the primary transfer roller to thereby press the primary transfer roller against the photosensitive drum, wherein the release member includes a slider being slidable in the moving direction of the intermediate transfer belt while provided between the pressing shaft and the first cover door, wherein a concave part and a convex part to engage with the first cover door are formed at the slider, and wherein when the convex part has engaged with the first cover door, the movement of the pressing shaft is stopped, and when the concave part has engaged with the first cover door, the movement of the pressing shaft towards the first cover door is permitted, the movement causing the support holder to separate from the abutted primary transfer roller.

7. The image forming apparatus according to claim 6, wherein the slider is slid in conjunction with the opening and closing of the second cover door.

8. The image forming apparatus according to claim 6, wherein the slider manually is slid independently of the opening and closing of the second cover door.

9. The image forming apparatus according to claim 8, wherein when the slider has been slid, the concave part is locked in a state in which the concave part engages with the first cover door, and wherein as a result of an opening operation of the first cover door, the locking is released, the slider slides oppositely, and the convex part engages with the first cover door.

* * * * *